United States Patent [19]

Discipio, Sr.

[11] Patent Number: 5,014,366

[45] Date of Patent: May 14, 1991

[54] ENHANCED VISIBILITY HELMET

[76] Inventor: William R. Discipio, Sr., 40 Wheelwright Rd., Hampstead, N.H. 03841

[21] Appl. No.: 485,031

[22] Filed: Feb. 26, 1990

[51] Int. Cl.[5] ..... A42B 3/06

[52] U.S. Cl. ..... 2/424; 2/413; 2/410

[58] Field of Search ..... 2/9, 205, 410, 411, 2/413, 424, 425, 6; 350/354

[56] References Cited

U.S. PATENT DOCUMENTS

| | | | |
|---|---|---|---|
| 2,988,749 | 6/1961 | Crouzet | 2/424 |
| 3,295,511 | 1/1967 | Croozet | 2/205 |
| 3,423,763 | 1/1969 | Schwartz | 2/205 |
| 3,707,004 | 12/1972 | Kapitan et al. | 2/424 |
| 4,233,689 | 11/1980 | Baron | 2/425 |
| 4,586,200 | 5/1986 | Poon | 2/413 |
| 4,605,000 | 8/1986 | Anguita | 2/424 |
| 4,663,785 | 5/1987 | Comparetto | 2/425 |
| 4,718,127 | 1/1988 | Rittmann et al. | 2/424 |
| 4,731,885 | 3/1988 | Nava | 2/424 |
| 4,845,786 | 7/1989 | Chiarella | 2/425 |

FOREIGN PATENT DOCUMENTS

| | | | |
|---|---|---|---|
| 1034701 | 7/1978 | Canada | 2/424 |
| 589842 | 3/1959 | Italy | 2/424 |
| 8704323 | 1/1987 | PCT Int'l Appl. | 2/410 |

*Primary Examiner*—Peter Nerbun
*Assistant Examiner*—Michael A. Neas
*Attorney, Agent, or Firm*—Leon Gilden

[57] ABSTRACT

A helmet structure including a transparent shell. The transparent shell including a matrix of ventilation apertures coextensive with the shell. The shell further including a visor mounted at a forward end thereof overlying a forward facial opening, including lateral ventilation ports positioned coextensive with the visor laterally displaced side edges. The shell includes a multilayer construction, including an inner and outer transparent layer sandwiching a central laminate layer of photochromic material to accommodate various environmental lighting conditions. A modification of the invention includes a further inner layer defined by an inflatable transparent polymeric material, including a squeeze bulb to direct air interiorly thereof to accommodate individuals' varying cranial geometric configurations, as well as providing an enhanced safety layer within the helmet structure.

4 Claims, 4 Drawing Sheets

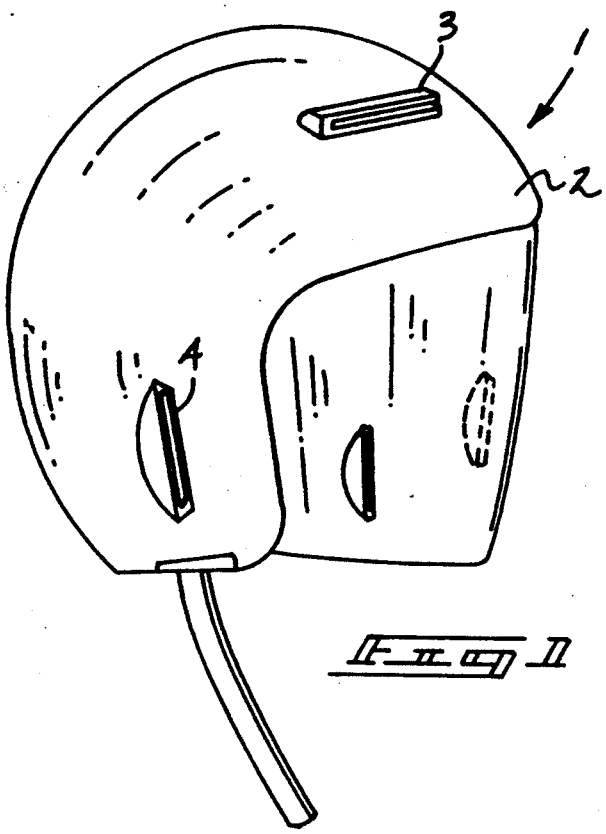
FIG 1
PRIOR ART
FIG 2
PRIOR ART
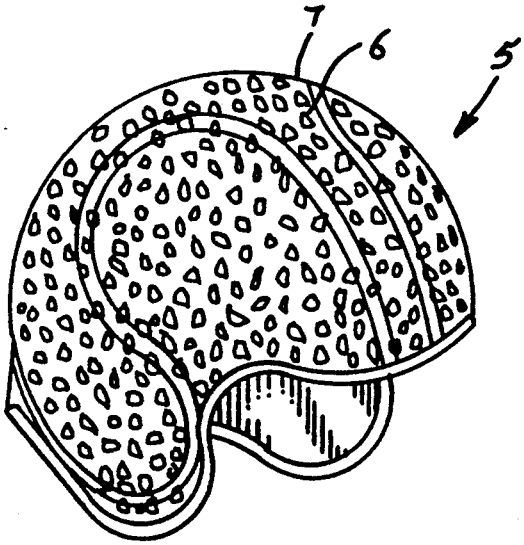

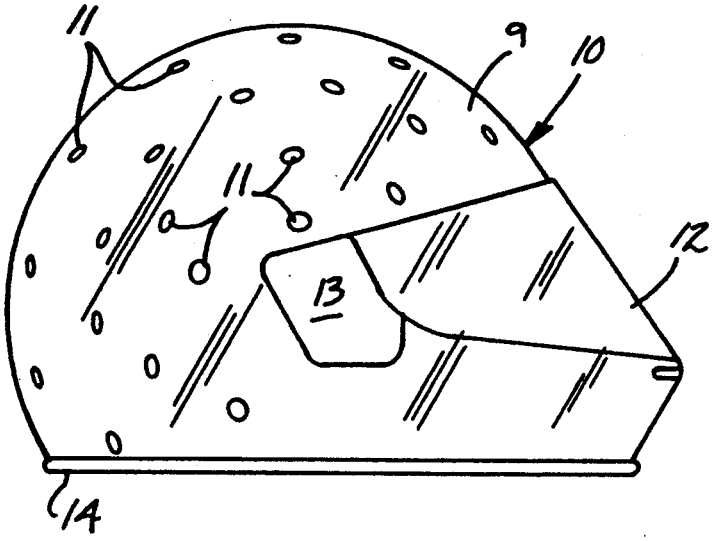
Fig 3
Fig 4
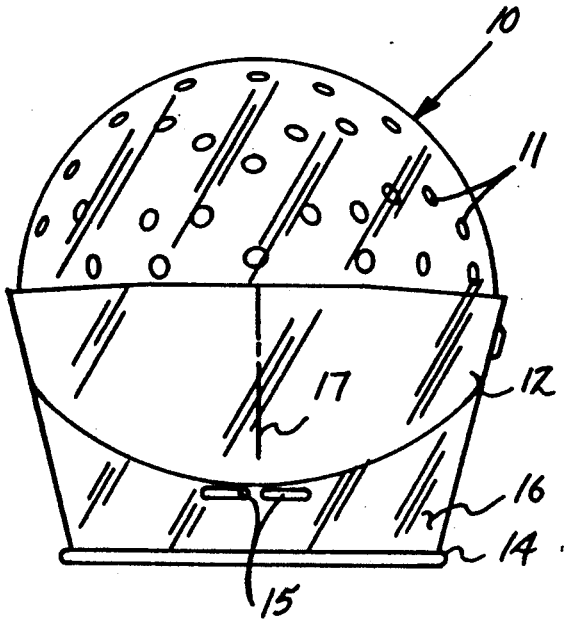

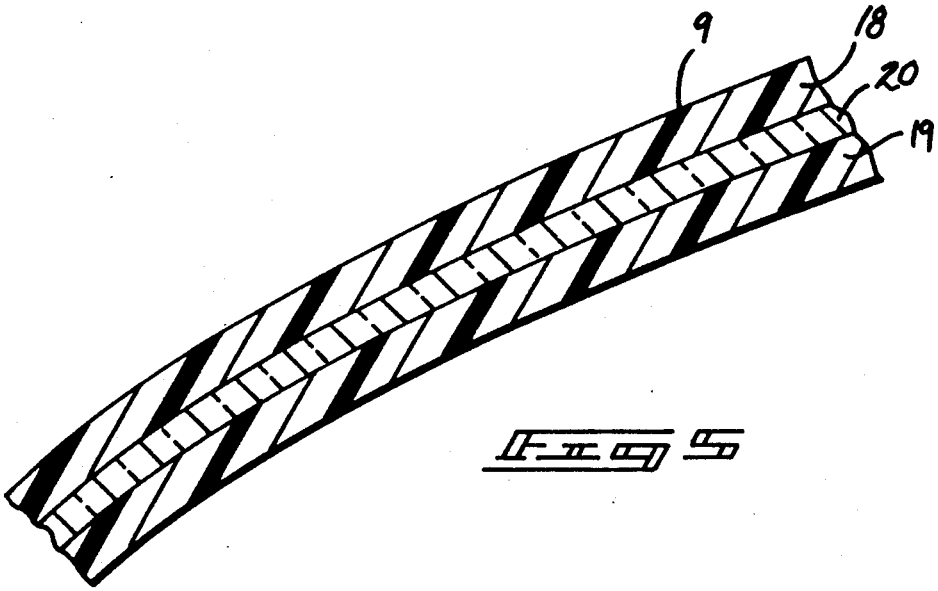
Fig 5
Fig 6
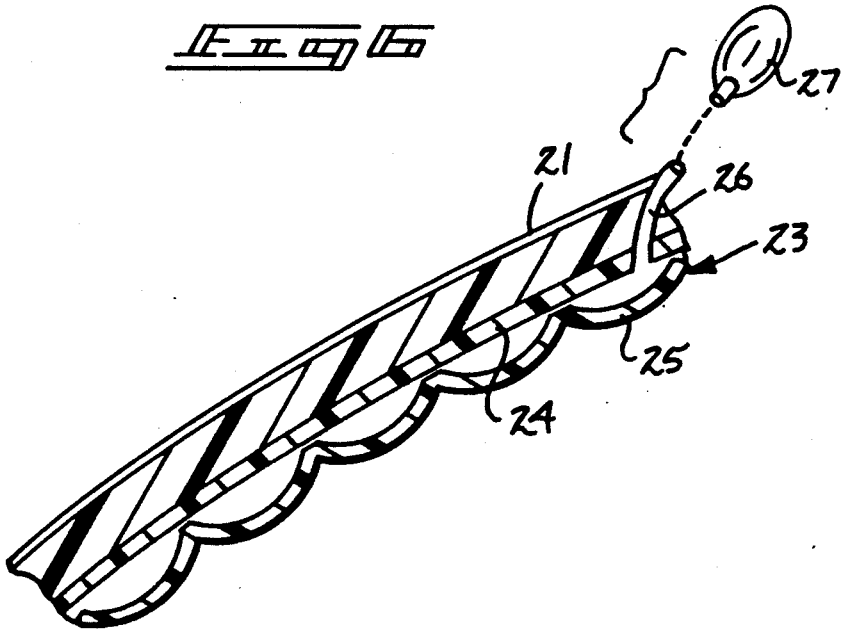

ENHANCED VISIBILITY HELMET

BACKGROUND OF THE INVENTION

1. Field of the Invention

The field of invention relates to helmet construction, and more particularly pertains to a new and improved enhanced visibility helmet wherein the same provides complete visibility directed through the helmet, as well as providing a coextensive matrix of apertures directed through the helmet shell for ventilation interiorly thereof.

2. Description of the Prior Art

Helmet construction of various types is known in the prior art. Helmets are deemed to be mandatory or highly recommended in various endeavors, such as sport, bicycle and motorcycle events. Helmet construction of the prior art has heretofore failed to set forth the combination as provided by the instant invention of producing an enhanced visibility helmet in cooperation with self-conforming inner liner, as well as a photochromic liner utilized by the instant invention. Examples of the prior art include U.S. Pat. No. 4,141,085 to Adams, Sr. wherein the safety helmet includes a plurality of air vents formed in surrounding relationship relative to a forward opening of the helmet.

U.S. Pat. No. 4,008,949 to Luna utilizes an exterior clear gel coat sprayed under pressure to a helmet mold to provide a transparent layer, with a further layer of reflective chips embedded and sprinkled within the gel.

U.S. Pat. No. 4,605,000 to Anguita provides a greenhouse-type helmet devising a plant secured within the dome.

U.S. Pat. No. 3,075,200 to Crouzet provides a helmet structure formed of transparent segments of laminated sheets of material, with apertures directed through discrete portions of the sheets.

U.S. Pat. No. 4,446,576 to Hisataka provides a helmet, including enhanced safety features for use in fighting arts utilizing a resilient cover body in the viewing window for providing adequate breathing through the cover window.

As such, it may be appreciated that there continues to be a need for a new and improved enhanced visibility helmet as set forth by the instant invention which addresses both the problems of ease of use, as well as effectiveness in construction and in this respect, the present invention substantially fulfills this need.

SUMMARY OF THE INVENTION

In view of the foregoing disadvantages inherent in the known types of helmet constructions now present in the prior art, the present invention provides an enhanced visibility helmet wherein the same provides enhanced visibility with a coextensive matrix of apertures directed through the helmet shell, and wherein the shell is provided of a multi-layer construction to provide various physical characteristics utilized in helmet usage, such as photochromic material, as well as a pneumatic cushion layer interiorly of the helmet. As such, the general purpose of the present invention, which will be described subsequently in greater detail, is to provide a new and improved enhanced visibility helmet which has all the advantages of the prior art helmet constructions and none of the disadvantages.

To attain this, the present invention provides a helmet structure including a transparent shell. The transparent shell including a matrix of ventilation apertures coextensive with the shell. The shell further including a visor mounted at a forward end thereof overlying a forward facial opening, including lateral ventilation ports positioned coextensive with the visor laterally displaced side edges. The shell includes a multi-layer construction, including an inner and outer transparent layer sandwiching a central laminate layer of photochromic material to accommodate various environmental lighting conditions. A modification of the invention includes a further inner layer defined by an inflatable transparent polymeric material, including a squeeze bulb to direct air interiorly thereof to accommodate individuals' varying cranial geometric configurations, as well as providing an enhanced safety layer within the helmet structure.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved enhanced visibility helmet which has all the advantages of the prior art helmet constructions and none of the disadvantages.

It is another object of the present invention to provide a new and improved enhanced visibility helmet which may be easily and efficiently manufactured and marketed.

It is a further object of the present invention to provide a new and improved enhanced visibility helmet which is of a durable and reliable construction.

An even further object of the present invention is to provide a new and improved enhanced visibility helmet which is susceptible of a low cost of manufacture with regard to both materials and labor, and which accordingly is then susceptible of low prices of sale to the consuming public, thereby making such enhanced visibility helmets economically available to the buying public.

Still yet another object of the present invention is to provide a new and improved enhanced visibility helmet which provides in the apparatuses and methods of the prior art some of the advantages thereof, while simultaneously overcoming some of the disadvantages normally associated therewith.

Still another object of the present invention is to provide a new and improved enhanced visibility helmet wherein the same accommodates a matrix of apertures coextensively formed throughout the shell defining the helmet to permit enhanced ventilation, as well as visibility through the completely transparent shell of the helmet structure.

These together with other of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is an isometric illustration of a prior art helmet.

FIG. 2 is an isometric illustration of a further prior art helmet.

FIG. 3 is an orthographic side view of the instant invention.

FIG. 4 is an orthographic frontal view of the instant invention.

FIG. 5 is an orthographic cross-sectional view of the helmet layer construction of the instant invention.

FIG. 6 is an orthographic cross-sectional view of a modified helmet layer construction of the instant invention.

DESCRIPTION OF THE PREFERRED EMBODIMENT

Figure 7:
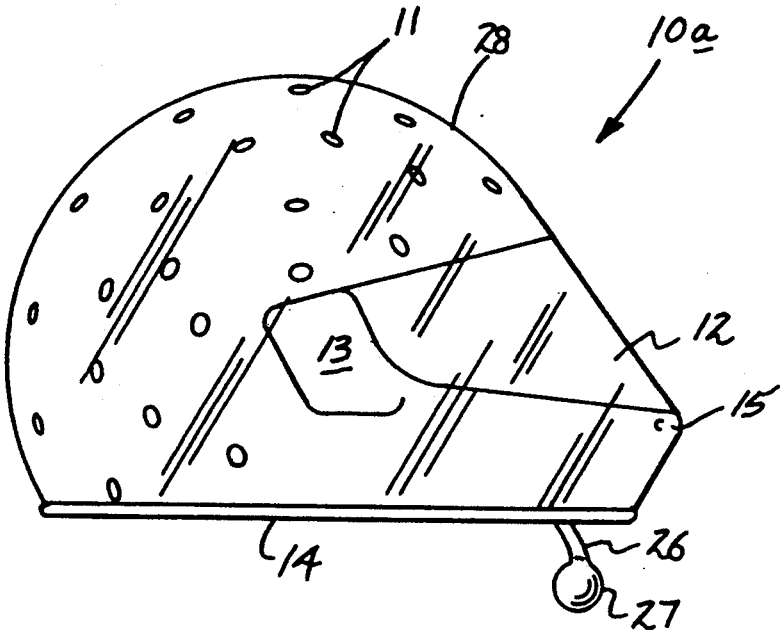
FIG. 7 is an orthographic side view taken in elevation of a modified helmet of the instant invention.

With reference now to the drawings, and in particular to FIGS. 1 to 8 thereof, a new and improved enhanced visibility helmet embodying the principles and concepts of the present invention and generally designated by the reference numerals 10 and 10*a* will be described.

FIG. 1 illustrates a prior art helmet construction 1 defining a shell 2 formed with a plurality of ventilation apertures directed therethrough, such as an upper ventilation slot 3 and side ventilation slot 4. FIG. 2 utilizes a further prior art shell wherein a transparent gel 6 is formed over a mold, with reflective opaque particles 7 formed therein to provide reflective surfaces throughout the shell structure.

More specifically, the enhanced visibility helmet 10 of the instant invention essentially comprises a completely transparent shell 9 formed with a matrix of through-extending apertures 11 directed orthogonally through the shell structure throughout its surface. A visor 12 is mounted overlying a forward facial opening of the helmet, with lateral vent openings 13 mounted coextensive with the side edges of the visor 12 to provide enhanced ventilation through the helmet. A cushioned lower continuous perimeter edge 14 is formed about the lowermost edge of the shell. Mouth vents 15 are directed through the forward arcuate surface 16 of the shell and equally spaced about the center line 17 dividing the side halves of the shell.

FIG. 5 illustrates the shell structure 9 formed with an outer polymeric transparent layer 18 defined by a ten to twenty mil layer thickness, with an inner polymer transparent layer 19 spaced from the outer polymeric transparent layer 18 of an equal thickness. A central translucent layer 20 is formed of a photochromic polymeric or glass shell and is laminated between the outer and inner transparent layers 18 and 19, and is of a five to ten mil thickness. The photochromic central layer 20 permits a darkening of the shell structure 9 in the presence of enhanced light conditions.

Figure 8:
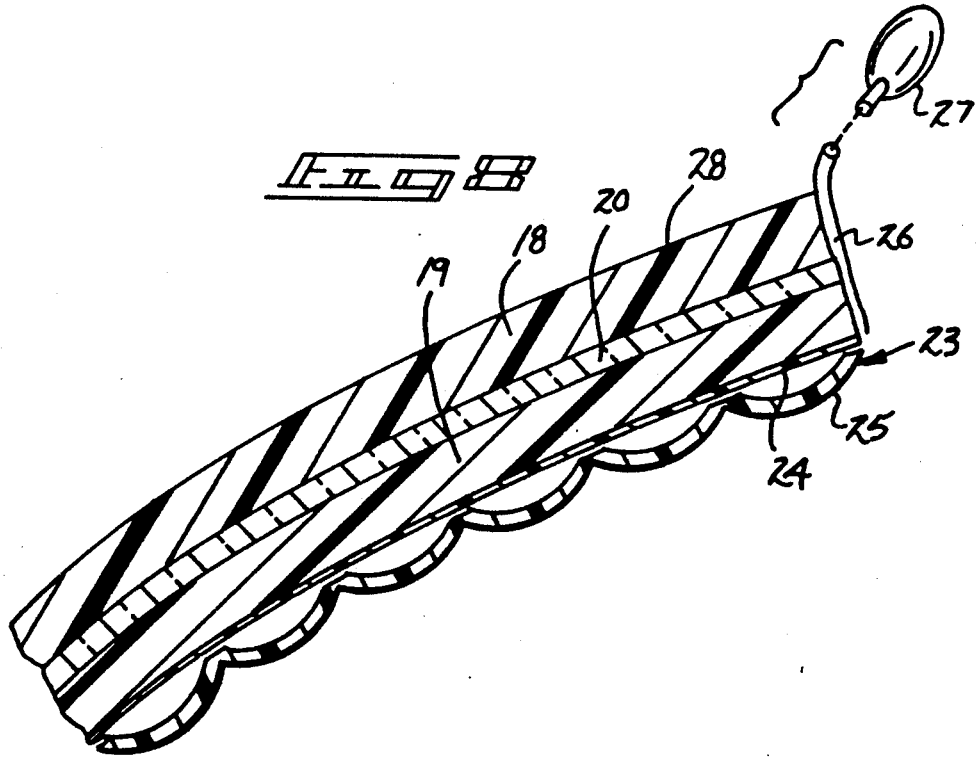
FIG. 8 is an orthographic cross-sectional view of the modified helmet layer structure of FIG. 7 utilizing a multi-layer structure defining the shell of the helmet.

FIG. 6 illustrates a modified shell 21 formed with an outer transparent polymeric layer 22 and an inner pneumatic liner 23. The inner liner 23 defines pneumatic chamber between a transparent first sheet 24 laminated contiguously and coextensively with the outer transparent layer 22 against an inner surface thereof, with a transparent second blister sheet layer 25 spaced from the transparent first sheet 24 defined by an undulating surface of semi-spherical projections formed throughout the sheet 25, whereupon inflation of the pneumatic inner liner 23 accommodates various geometric configurational differences between individuals, as well as providing an enhanced cushioning layer accommodating impact. A conduit 26 is directed from the interior pneumatic chamber of the inner pneumatic liner 23 exteriorly through the modified shell 21 to a squeeze bulb 27 to direct pressurized air therein. FIGS. 7 and 8 illustrate the modified shell construction 28 utilizing both the outer and inner transparent layers 18 and 19, with the central translucent photochromic layer 20 therebetween, as well as providing use of the pneumatic inner liner 23 and the associated conduit 26 to direct pneumatic air under pressure into the chamber defined by the pneumatic liner 23 from the associated squeeze bulb 27, wherein the conduit 26 is directed through all of the aforenoted layers.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A helmet construction comprising, in combination, a helmet shell, the helmet shell including a forward facial opening, the facial opening including a visor mounted thereon, the visor including spaced, lateral edges, and the shell including first openings coextensive with the lateral edges of the visor, and the helmet further including a matrix of through-extending apertures orthogonally directed through the shell, and further including a forward, arcuate surface of the shell underlying the facial opening and including a plurality of vents directed through the arcuate surface, the vents being equally spaced about a center line of the shell, and wherein the shell includes an outer polymeric transparent layer and an inner polymeric transparent layer, and each transparent layer is coextensive with the shell, and wherein the outer and inner layer are defined by a predetermined thickness, the thickness defined by a range from ten to twenty mil thickness, and further including a central translucent photochromic layer coextensive with and laminated between the outer layer and the inner layer, the photochromic layer defined by a thickness range from a five to ten mil thickness.

2. A helmet construction as set forth in claim 1 further including a transparent first sheet coextensively laminated to an interior surface of the inner transparent layer, and further including a second sheet spaced from the first sheet defining a pneumatic chamber therebetween, and a conduit directed through the shell in communication with the pneumatic chamber, and pressurizing means associated with the conduit means for effecting selective pressurization of the pneumatic chamber.

3. A helmet construction as set forth in claim 2 wherein the pressurizing means is defined by a squeeze bulb.

4. A helmet construction as set forth in claim 3 wherein the transparent second sheet is defined by an undulating surface defined by semi-spherical projections coextensively directed exteriorly of the second sheet.

* * * * *